US006351904B1

(12) United States Patent
Hermanson

(10) Patent No.: US 6,351,904 B1
(45) Date of Patent: Mar. 5, 2002

(54) PICTURE FRAME LIGHT STRING DISPLAY

(75) Inventor: Terry Hermanson, New York, NY (US)

(73) Assignee: Mr. Christmas, Inc., New York, NY (US)

( * ) Notice: Subject to any disclaimer, the term of this patent is extended or adjusted under 35 U.S.C. 154(b) by 0 days.

(21) Appl. No.: 09/588,327

(22) Filed: Jun. 6, 2000

(51) Int. Cl.[7] ..... G09F 13/01
(52) U.S. Cl. ..... 40/715; 40/559; 428/7
(58) Field of Search ..... 40/715, 559, 562; 428/7

(56) References Cited

U.S. PATENT DOCUMENTS

| | | | | | |
|---|---|---|---|---|---|
| 1,423,433 | A | * | 7/1922 | Ketchem | 40/715 |
| 5,761,838 | A | * | 6/1998 | Chisholm et al. | 40/716 |
| 5,813,155 | A | * | 9/1998 | Shen | 40/715 |
| 6,143,381 | A | * | 11/2000 | Hawkins | 428/7 |
| 6,226,908 | B1 | * | 5/2001 | Byers | 40/575 |

* cited by examiner

*Primary Examiner*—Cassandra H. Davis

(74) *Attorney, Agent, or Firm*—Fitzpatrick, Cella, Harper & Scinto

(57) ABSTRACT

A light string display includes a plurality of lighted picture frames, where each picture frame includes a frame having a rear flange and a front border defining an interior viewing area. Each picture frame also includes a back plate, an electric lamp, a hanger, a stand, and a mount. The back plate is receivable in the flange for holding a display item between the frame and the back plate in the interior viewing area, and the mount is fixable to the back plate for supporting the electric lamp, and for providing electrical connection to the electric lamp. The mount selectively supports the hanger in an extended/exposed position for hanging the frame on an external support structure; the mount also selectively supports the stand in an extended position for supporting the frame in an upright orientation on a support surface. Wiring connects respective mounts of the picture frames in series and electrically connects respective electric lamps of the picture frames to a power source. Each picture frame further optionally includes a transparent plate receivable in a respective flange of a frame between the frame and a respective back plate, for holding a display item between the transparent plate and the back plate in the interior viewing area. The wiring may include a standard electrical plug for electrically connecting the display to a standard electrical wall outlet.

23 Claims, 4 Drawing Sheets

PICTURE FRAME LIGHT STRING DISPLAY

BACKGROUND OF THE INVENTION

1. Field of the Invention

The present invention generally relates to display devices. More particularly, the present invention relates to a novel light string display in which a plurality of lighted picture frames are strung together by electrical wiring and provided with alternative support elements that may be selectively employed to support the display on various external support structures.

2. Related Art

Light string displays are known, such as for Christmas tree decorations. Conventional light string displays generally include a plurality of light bulbs strung together physically in series configuration by electrical wiring (although the electrical connectors between bulbs may be in series or in parallel), and typically are supported by draping the light string over a supporting structure, like Christmas tree branches, or securing the light string to a supporting structure, such as a roof soffit or the like, by conventional securing means, such as ties, tacks, staples, or the like. It also is known to provide decorative pieces, such as miniature houses, imitation candy cane structures or other figurines (for example, angels, Santa Claus, elves, reindeer and other animals, and the like), in conjunction with the light bulbs, for example, by snap fitting such pieces over the light bulbs.

These conventional light string displays have utility in many applications. Nevertheless, it is desirable to provide an improved light string display that variably presents a unique or personal aspect, and which may be displayed in association with various supporting structures.

SUMMARY OF THE INVENTION

The present invention relates to a light string display comprising a plurality of lighted picture frames strung together with electrical wiring, where each picture frame is provided with alternative structures for selectively supporting the picture frame by hanging from or standing on various external support structures.

In one aspect, a light string display of the present invention includes a plurality of picture frames, where each picture frame comprises a frame, an electric lamp, a hanger, a stand, and a mount fixed on a back side of the picture frame, and where each mount supports a respective electric lamp, hanger, and stand. The wiring is connected to each mount of the plurality of picture frames, and electrically connects each electric lamp to a power source.

In another aspect, each frame may comprise a rear flange and a front border defining an interior viewing area, and each picture frame may further comprise a back plate securely receivable in the flange for holding a display item, such as a picture, between the frame/flange and the back plate. In this manner, the item may be viewed in the interior viewing area.

In another aspect, each interior viewing area may be an opening defined by a respective border. In this aspect, each picture frame further may comprise an optional transparent plate receivable in a respective flange, between the flange and a respective back plate, for holding the display item between the transparent plate and the back plate. In this manner, the item may be viewed in the interior viewing area.

In another aspect, each mount may be fixed to a respective back plate of a picture frame. In a preferred embodiment, each element of the picture frame is formed of a molded plastic, and each mount is fixed to a respective back plate by conventional means, such as molding, spot welding, adhesion, press fitting, screws, or the like.

In another aspect, each hanger is selectively movable between a first position, in which the hanger is extended and exposed for hanging the picture frame on an external support structure, such as a picture hook or a Christmas tree branch, and a second position, in which the hanger is retracted, that is, not exposed for hanging the picture frame. In a preferred embodiment, each hanger comprises a hook rotatably supported at one end by a fitting of a respective mount, and is selectively movable between the first position and the second position by rotation about the fitting.

In another aspect, each stand is selectively movable between a first position, in which the stand is extended at an angled orientation relative to a respective frame so as to support the picture frame in an upright orientation on an external support surface, such as a table, mantle or window sill, and a second position, in which the stand is retracted proximate the frame. In a preferred embodiment, each stand comprises an easel leg pivotably supported at one end by a fitting of a respective mount.

In another aspect, each electric lamp comprises an arm supported at one end by a respective mount, where the arm extends above a respective frame and bends back upon itself in a U-shape to a front side of the frame, and a lamp shade supported at the other end of the arm for housing an electric light bulb. In a preferred embodiment, each lamp shade extends generally along a direction of a width of the frame, for directing light onto the interior viewing area of the frame.

In another aspect, the wiring may connect the plurality of picture frames in physically a series configuration, thereby forming a light string display.

In another aspect, each frame comprises a flange having a respective predetermined geometric shape, and each back plate has a respective corresponding geometric shape. Each predetermined geometric shape may be different. Alternatively, each flange may have the same geometric shape, like, for example, a rectangular geometric shape, thereby permitting interchangeability of parts.

In another aspect, each frame may have a decorative design or pattern formed on a respective border thereof. Each decorative pattern may be the same or different.

In yet another aspect, the present invention relates to a light string display including a plurality of frames, such as five picture frames, where each picture frame comprises a frame including a rear flange and a front border defining an interior viewing area, a back plate receivable in the flange and holding a display item between the frame/flange and the back plate for viewing of the item in the interior viewing area, an electric lamp, a hanger, a stand, and a mount. Each mount is fixable to a back plate and supports an electric lamp, provides an electrical connection to the electric lamp, supports the hanger in an extended and exposed position for hanging the picture frame on an external support structure, and supports the stand in an extended position for supporting the frame in an upright orientation on an external support surface. Wiring connects respective mounts of the frames physically in series, and electrically connects respective electric lamps of the picture frames in series or parallel to a power source. In one embodiment, each picture frame optionally comprises a transparent plate receivable in a respective flange of a frame, between the frame/flange and a respective back plate, for holding a display item between the transparent plate and the back plate for viewing in the interior viewing area. Also in a preferred embodiment, the wiring includes a standard electrical plug for electrically connecting the light string display to a standard electrical wall outlet.

These and other objects, features and advantages of the present invention will be apparent from the following description of the preferred embodiments of the present invention.

BRIEF DESCRIPTION OF THE DRAWINGS

The present invention will be more readily understood from the detailed description of the preferred embodiments taken in conjunction with the following figures.

DETAILED DESCRIPTION OF THE PREFERRED EMBODIMENTS

FIGS. 1 to 4 illustrate an embodiment of a light string display of the present invention, where like or similar reference numbers represent like or corresponding structural elements and features throughout the drawings. In this embodiment, the light string display includes a plurality of lighted picture frames serially connected physically by electrical wiring to a standard electrical plug that may be plugged into a standard electrical outlet.

Figure 1:
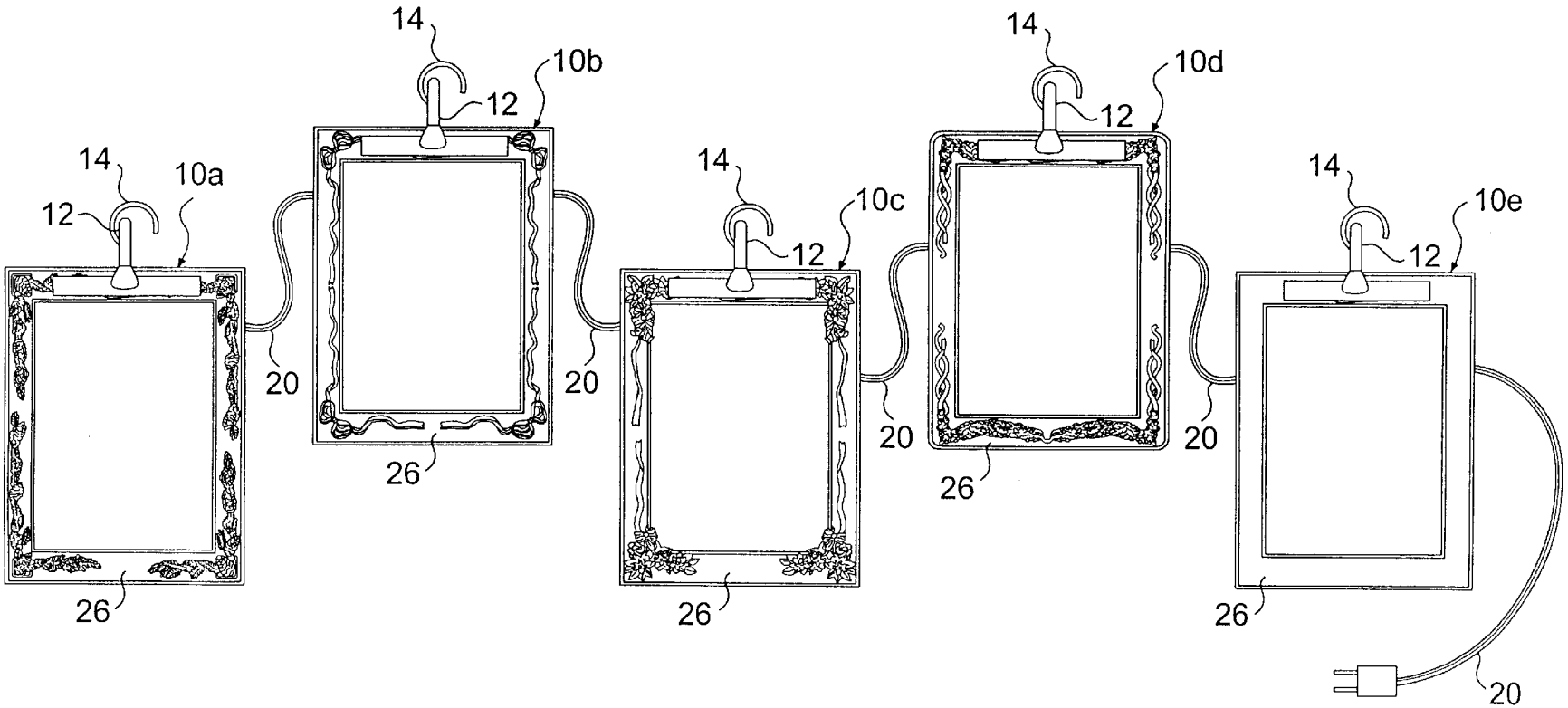
FIG. 1 illustrates an embodiment of a light string display of the present invention.

As shown in FIG. 1, in the present embodiment the number of lighted picture frames is five. However, it readily will be appreciated that any number of lighted picture frames may be connected serially to form a light string display according to the present invention.

Figure 2:
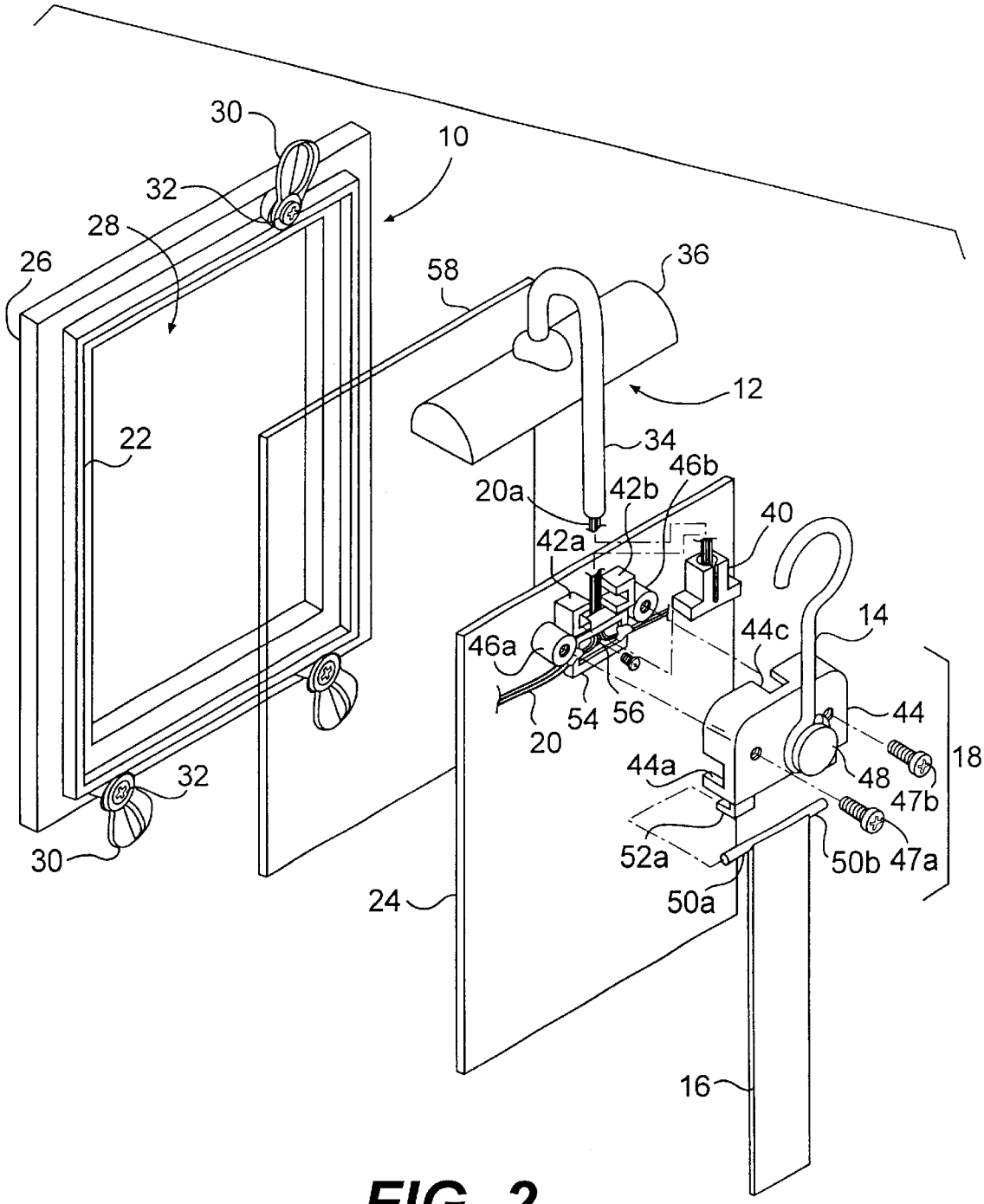
FIG. 2 is an exploded perspective view of a representative picture frame of the light string display of FIG. 1.

FIG. 2 is an exploded perspective view of a lighted picture frame of the light string display of FIG. 1. As shown therein, each lighted picture frame generally includes a frame 10, an electric lamp 12, a hanger 14, a stand 16 and a mount 18, all connected by electrical wiring 20.

In the present embodiment, frame 10 includes a flange 22 formed on a rear face thereof. The front face of frame 10 provides a border 26 around the perimeter of the picture frame, and defines an interior viewing area 28 of the picture frame.

Flange 22 defines a seat for receiving back plate 24. When back plate 24 is seated in flange 22, it may be secured therein by conventional securing means, such as screws, clips, clamps, and the like. In the embodiment of FIG. 2, back plate 24 is seated in flange 22 and secured therein by three rotatable clips 30 mounted to frame 10 by screws 32.

Each flange 22 may be any geometric shape, provided each respective back plate 24 has a corresponding or complimentary geometric shape that seats in flange 22. Of course, each flange 22 may have a different shape, provided each respective back plate 24 has a corresponding or complimentary geometric shape that seats in a flange 22. In the embodiment of FIGS. 1 to 4, each flange 22 has the same geometric shape, i.e., a rectangular geometric shape. This design permits interchangeability of parts among the plurality of picture frames, and thereby increases versatility and reduces manufacturing costs. Nevertheless, it readily will be appreciated that numerous variations of geometry, including regular and irregular geometric shapes, may be combined to provide a wide variety of applications.

The presence of a flange and the number and structure of any clips or other securing means also may vary depending on the desired application. Those skilled in the art readily will recognize suitable alternative structures and means for securing and/or seating back plate 24 on frame 10.

Each electric lamp 12 generally comprises an arm 34 and a lamp shade 36. Arm 34 generally is supported at one end (the proximal end) on the back side of a picture frame, for example, by mount 18. In the embodiment of FIG. 2, arm 34 is a tubular element housing electrical wiring 20*a* and extends upward, away from the mount 18, and then is bent back upon itself in a U-shape, whereby the other end (the distal end) of arm 34 is located at the front side of frame 10. Lamp shade 36 is fixed on the other end (the distal end) of arm 34 and houses an electric light bulb 38. In the present embodiment, lamp shade 36 extends in a direction of the width of frame 10, substantially parallel to the front face of frame 10, for directing light from the light bulb 38 onto the internal viewing area 28 of the picture frame.

In the embodiment of FIG. 2, arm 34 is mounted by press fitting or adhering the proximal end thereof into a mounting orifice of an inverted T-shaped insert 40 of mount 18. The inverted T-shaped insert 40 in turn is captured within opposing U-shaped bosses 42*a,* 42*b* and an outer housing 44 of mount 18. U-shaped bosses 42*a,* 42*b* are fixed to back plate 24, and outer housing 44 also is fixed to back plate 24 by conventional means, thereby providing vertical support to arm 34. For example, in the embodiment of FIG. 2, threaded bosses 46*a,* 46*b* are fixed to back plate 24, for example, by integral molding, spot bonding, adhesion, or the like, and outer housing 44 then is fixed to back plate 24 by removable screws 47*a,* 47*b.* This configuration provides a simple and inexpensive manufacturing method. However, those skilled in the art readily will appreciate suitable alternative structures and configurations for reliably securing arm 34 of electric lamp 12 to mount 18 of the picture frame.

Figure 3A:
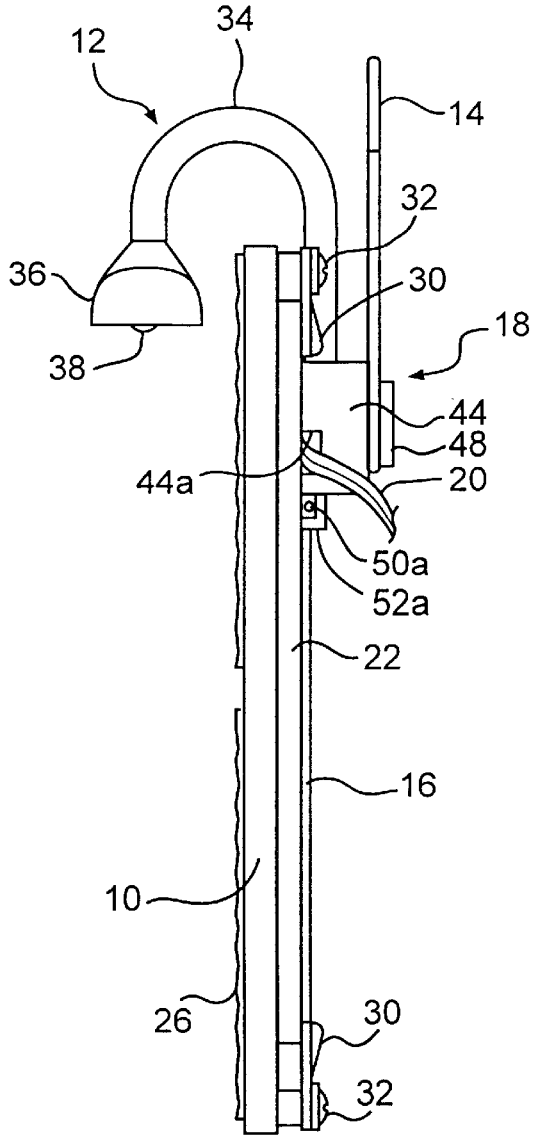
FIGS. 3A and 3B respectively are right and left side views of the frame of FIG. 2, illustrating the hanger of the picture frame in an extended/exposed configuration, and illustrating the stand of the picture frame in a retracted configuration, for hanging the picture frame from an external support structure.
Figure 3B:
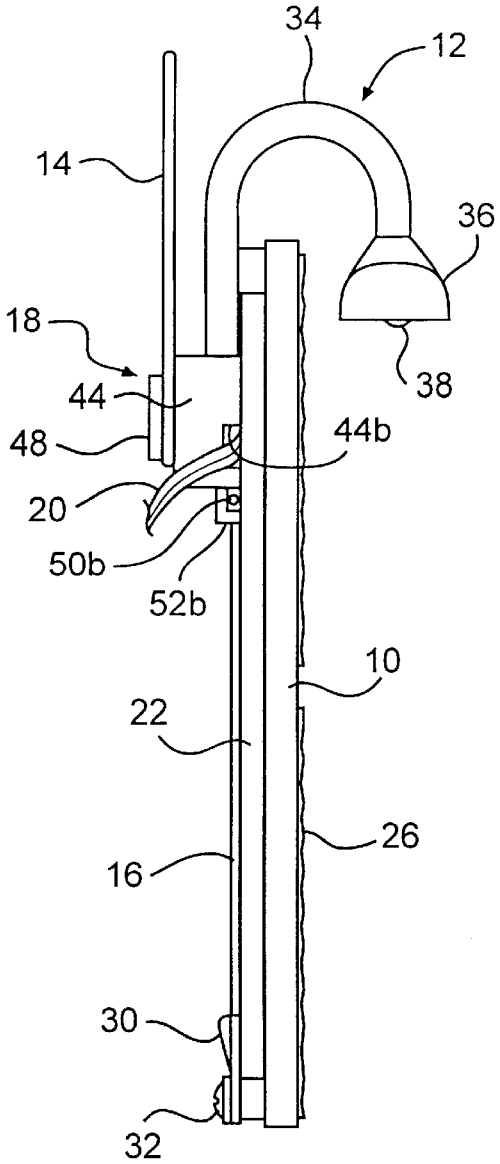
Figure 4A:
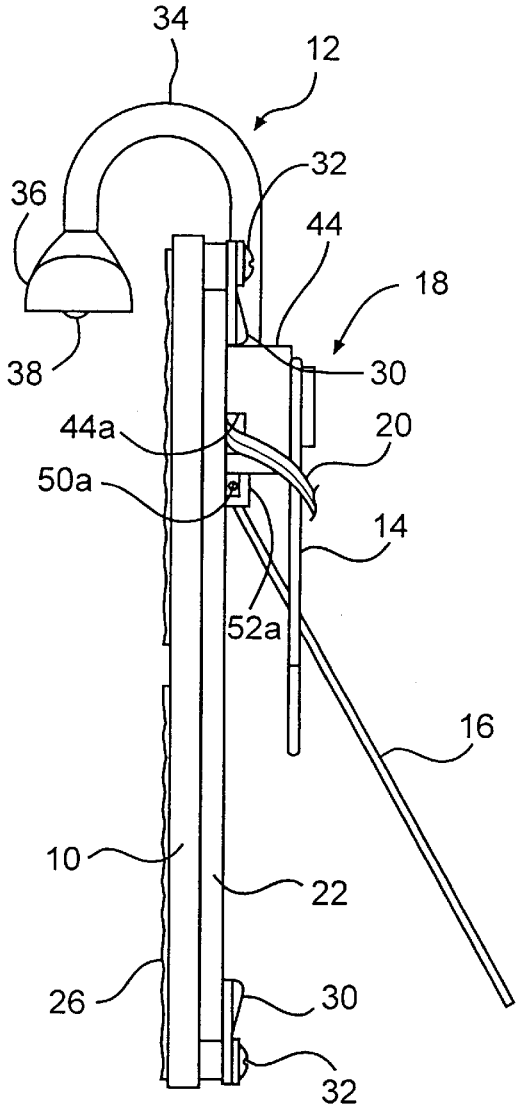
FIGS. 4A and 4B respectively are right and left side views of the frame of FIG. 2, illustrating the hanger of the picture frame in a retracted/non-exposed configuration, and illustrating the stand of the picture frame in an extended configuration, for supporting the picture frame on an external supporting surface.
Figure 4B:
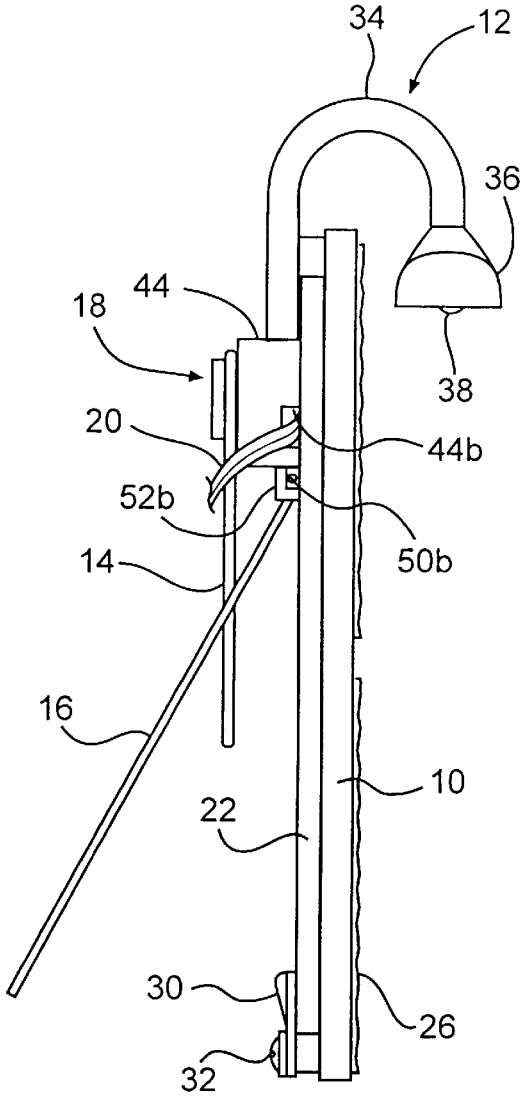

Each hanger 14 is supported at one end (the proximal end) by one mount 18 for movement between a first position, where the other end (the distal end or hook) of hanger 14 is extended upward, away from mount 18 and frame 10, and thereby exposed for hanging the picture frame on an external support structure, such as a picture hook or a branch of a Christmas tree (see also FIGS. 3A and 3B), and a second position, where the distal end/hook of hanger 14 is retracted (i.e., not extended upward), and thereby not exposed for hanging the picture frame (see also FIGS. 4A and 4B). In the embodiment of FIG. 2, mount 18 comprises a button-topped boss fitting 48, and the proximal end of hanger 14 comprises a ring rotatably pivotable about fitting 48. However, those skilled in the art readily will appreciate suitable alternative structures and configurations for achieving the desired function of hanger 14.

Each stand 16 likewise is supported at one end (the proximal end) by a respective mount 18 for movement between a first position, where stand 16 is extended away from frame 10 for supporting frame 10 in an upright orientation on an external support surface, such as a tabletop, mantle, or window sill (see also FIGS. 4A and 4B), and a second position, where stand 16 is retracted proximate frame 10 (see also FIGS. 3A and 3B). In the embodiment of FIG. 2, stand 16 is an easel leg including a pair of opposing projections 50*a,* 50*b* formed at the proximal end thereof and thereby forming a pivot axis pivotably supportable by respective opposing pivot mounts 52*a,* 52*b* formed on a lower side of mount 18 (see also FIGS. 3A, 3B, 4A and 4B). Of course, those skilled in the art readily will appreciate suitable alternative mounting structures and configurations for achieving the desired function of stand 16.

As shown in FIG. 2, housing 44 of mount 18 also includes opposing cutout portions 44*a,* 44*b* for receiving electrical wiring 20, and cutout portion 44*c* for receiving arm 34 of electric lamp 12. In a preferred embodiment, mount 18 further includes an electrical contact boss 54 fixed to back plate 24 for housing an electrical contact plate 56. Wiring 20 is fed into an interior chamber of mount housing 44 through cutout portions 44*a,* 44*b* and electrically connected to respective terminals of contact plate 56; wiring 20*a* provided in arm 34 also is electrically connected to respective terminals of contact plate 56 to provide electrical power to light bulb 38 housed in lamp shade 36. Those skilled in the art readily will appreciate suitable alternative structures and electrical circuit configurations for providing electrical power to light bulb 38 of electric lamp 12.

Each of the various elements of frame 10 discussed above in connection with the preferred embodiments may be made of conventional materials by conventional manufacturing techniques. For example, in the embodiment of FIGS. 1 to 4, each of frame elements 12, 14, 16, 18, 22, 24, 26, 30, 34, 36, 40, 42*a,* 42*b,* 44, 46*a,* 46*b,* 48, 50*a,* 50*b,* 52*a,* 52*b* and 54 may be made of a molded plastic. Such construction permits rapid and inexpensive manufacture. Nevertheless, other materials, such as metal, glass, ceramic, composite resins, paper or paperboard products, and the like, as well as other manufacturing techniques, may be used in certain applications. Those skilled in the art readily will be able to select appropriate materials and manufacturing techniques for the various elements depending on the desired application.

As shown in FIG. 2, each picture frame optionally also may include transparent plate 58. The size, shape and geometry of transparent plate 58 is selected so as to seat within flange 22 of frame 10, between frame 10/flange 22 and back plate 24. In this manner, a display item, such as a picture, may be inserted and held between transparent plate 58 and back plate 24 within the viewing area of the picture frame. It readily will be appreciated that such configuration will maintain the item flat and protect the item from the external environment.

As shown in FIG. 1, each frame 10 may be provided with a pattern design on the border 24 thereof (see frames 10*a–d*); alternatively, the border 24 may be left plain, with no pattern provided thereon (see frame 10*e*). Each design pattern may be provided by conventional techniques, including any one or more of relief, painting, molding, etching, application, and the like. In this manner, picture frame light string displays selectively may be designed and readily may be adapted for any special occasion or holiday, such as weddings, Christmas, Hanukkah, and the like. Those skilled in the art readily will be able to select appropriate materials, manufacturing techniques and pattern designs for the various elements depending on the desired application.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modification and equivalent structures and function be used in certain applications.

What is claimed:

1. A light string display comprising:

a plurality of picture frames, each picture frame comprising:

a frame, including a border on a front face thereof defining an interior viewing area;

a back plate defining a space for receiving a display item viewable in the interior viewing area of the frame;

an electric lamp;

a hanger;

a stand; and a mount fixed on the back plate and supporting said electric lamp, said hanger, and said stand; and wiring connected to each mount of said plurality of picture frames and electrically connecting each electric lamp to a power source.

2. A light string display according to claim 1, wherein, for each picture frame, the frame further comprises a flange formed on a rear face thereof, and the back plate is receivable in the flange, for holding a display item between said frame and said back plate in the interior viewing area.

3. A light string display according to claim 2, wherein each flange has a respective predetermined geometric shape, and each back plate has a respective corresponding or complimentary geometric shape.

4. A light string display according to claim 3, wherein each flange has the same geometric shape.

5. A light string display according to claim 4, wherein each flange has a rectangular geometric shape.

6. A light string display according to claim 2, wherein each interior viewing area is an opening defined by the border of a frame.

7. A light string display according to claim 6, wherein each picture frame further optionally comprises a transparent plate receivable in the flange of the frame, between said frame and the back plate, for holding a display item between said transparent plate and said back plate in the interior viewing area.

8. A light string display according to claim 1, wherein, for each picture frame, the hanger is selectively movable between a first position, in which position said hanger is exposed for hanging the frame on an external support structure, and a second position, in which position said hanger is not exposed for hanging the frame.

9. A light string display according to claim 8, wherein, for each picture frame, the hanger comprises a hook rotatably supported at one end by a fitting of the mount, and is selectively movable between the first position and the second position by rotation about said fitting .

10. A light string display according to claim 1, wherein, for each picture frame, the stand is selectively movable between a first position, in which position said stand is extended from the frame to support said frame in an upright orientation on an external support surface, and a second position, in which position said stand is retracted proximate said frame.

11. A light string display according to claim 10, wherein the stand comprises an easel leg pivotably supported at one end by a fitting of the mount.

12. A light string display according to claim 1, wherein, for each picture frame, the electric lamp comprises:

an arm supported at one end by the mount, extending above the frame, and bending back upon itself in a U-shape to a front side of said frame; and a lamp shade supported at the other end of said arm for housing an electric light bulb.

13. A light string display according to claim 12, wherein the lamp shade extends generally along a direction of a width of said frame for directing light on the interior viewing area.

14. A light string display according to claim 1, wherein said wiring physically connects said plurality of picture frames in series configuration.

15. A light string display according to claim 14, wherein the number of said plurality of picture frames is five picture frames.

16. A light string display according to claim 1, wherein each frame is composed of a molded plastic.

17. A light string display according to claim 1, wherein each hanger, stand and mount is composed of a molded plastic.

18. A light string display according to claim 1, wherein each frame has a decorative pattern formed on the border thereof.

19. A light string display comprising:

a plurality of picture frames, each picture frame comprising:

a frame including a flange formed on a rear face thereof and a border on a front face thereof and defining an interior viewing area;

a back plate receivable in said flange for holding a display item between said frame and said back plate in the interior viewing area;

an electric lamp;

a hanger;

a stand; and a mount fixable to said back plate for supporting said electric lamp, for providing electrical connection to said electric lamp, for supporting said hanger in an exposed position for hanging said frame on an external support structure, and for supporting said stand in an extended position for supporting said frame in an upright orientation on a support surface; and wiring connecting respective mounts of said plurality of picture frames in series and electrically connecting respective electric lamps of said plurality of picture frames to a power source.

20. A light string display according to claim 19, wherein each picture frame further optionally comprises a transparent plate receivable in the flange of the frame, between said frame and the back plate, for holding a display item between said transparent plate and said back plate in the interior viewing area.

21. A light string display according to claim 20, wherein said wiring comprises a standard electrical plug for electrically connecting said light string display to a standard electrical wall outlet.

22. A light string display according to claim 19, wherein the number of said plurality of picture frames is five picture frames.

23. An ornamental display comprising:

a plurality of picture frames, each having a back plate; and means attached to each back plate for individually supporting each of said plurality of picture frames in a either a hanging orientation or a standing orientation, for electrically wiring said plurality of picture frames together, and for front lighting each of said plurality of picture frames.

* * * * *